US010758048B1

(12) United States Patent
Tsai

(10) Patent No.: US 10,758,048 B1
(45) Date of Patent: Sep. 1, 2020

(54) FOLDING CHAIR

(71) Applicant: SPORT DIVERSIONS INC., Taipei (TW)

(72) Inventor: Wen-Hao Tsai, New Taipei (TW)

(73) Assignee: SPORT DIVERSIONS INC., Taipei (TW)

( * ) Notice: Subject to any disclaimer, the term of this patent is extended or adjusted under 35 U.S.C. 154(b) by 0 days.

(21) Appl. No.: 16/390,051

(22) Filed: Apr. 22, 2019

(30) Foreign Application Priority Data

Mar. 14, 2019 (TW) ..... 108108625 A

(51) Int. Cl.
*A47C 4/28* (2006.01)
*A47C 3/00* (2006.01)

(52) U.S. Cl.
CPC ..... *A47C 4/286* (2013.01); *A47C 3/00* (2013.01)

(58) Field of Classification Search
CPC ..... A47C 3/00; A47C 4/286
USPC ..... 297/16.2, 45, 39
See application file for complete search history.

(56) References Cited

U.S. PATENT DOCUMENTS 6,634,705 B1 * 10/2003 Zheng ..... A47C 4/286 297/41
8,864,222 B2 * 10/2014 Grace ..... A47C 4/286 297/35
10,206,510 B2 * 2/2019 Choi ..... A47C 4/286
2016/0296023 A1 * 10/2016 Choi ..... A47C 4/286
2019/0216222 A1 * 7/2019 Winterhalter ..... A47C 4/286

* cited by examiner

*Primary Examiner* — Milton Nelson, Jr.
(74) *Attorney, Agent, or Firm* — Schmeiser, Olsen & Watts, LLP

(57) ABSTRACT

A folding chair includes left and right frame rods, left and right frame rotating elements, left and right rear leg sliding elements, left and right rear leg rods, left and right rear leg fixing elements, left and right back rest rods, left and right back rest rod sliding elements, left and right front leg rods, leg terminals, left and right connecting rods, left and right handrail rods, left and right handrail fixing elements, left and right handrail supporting rods, left and right supporting rod sliding elements, limiting elements, left and right sliding elements, supporting rods, pad portion and back rest portion. The folding chair is compact and portable when folded and demonstrates high stability and high load-bearing capability when unfolded.

12 Claims, 4 Drawing Sheets

FOLDING CHAIR

CROSS-REFERENCE TO RELATED APPLICATION

This non-provisional application claims priority under 35 U.S.C. § 119(a) on Patent Application No(s). 108108625 filed in Taiwan, R.O.C. on Mar. 14, 2019, the entire contents of which are hereby incorporated by reference.

BACKGROUND OF THE INVENTION

1. Field of the Invention

The present disclosure relates to folding chairs and, more particularly, to a folding chair not only can be folded to store but can also be unfolded to use.

2. Description of the Related Art

A conventional folding chair consists of a frame, two legs, a pad and a back rest. The legs movably cross the frame. The pad movably fits to the frame. The back rest is mounted on the top of the frame. Therefore, the legs and the pad are unfolded on one side of the frame such that a sitter can sit on the pad. Alternatively, the legs and the pad can press against each other toward the frame, thereby allowing the folding chair to be folded.

However, the conventional folding chair has drawbacks described below. Folding the conventional folding chair involves pressing the legs and the pad against each other toward the frame; as a result, the width of the frame and the width of the pad remain unchanged, regardless of whether the conventional folding chair is folded or unfolded, and thus the conventional folding chair takes up much space and is not portable. Furthermore, after the folding chair has been unfolded, only the bottom of the frame and the legs are in contact with the ground to bear the weight of the folding chair, thereby compromising the stability and load-bearing capability of the folding chair.

Therefore, it is imperative to provide a folding chair which can be folded up like an umbrella and thus takes up little space and is portable and can be unfolded to demonstrate high stability and high load-bearing capability.

BRIEF SUMMARY OF THE INVENTION

In view of the aforesaid drawbacks of the prior art, it is an objective of the present disclosure to provide a folding chair which can be folded up like an umbrella and thus takes up little space and is portable and can be unfolded to demonstrate high stability and high load-bearing capability.

In order to achieve the above and other objectives, the present disclosure provides a folding chair, comprising a left frame rod, a right frame rod, a left frame rotating element, a right frame rotating element, a left rear leg sliding element, a right rear leg sliding element, a left rear leg rod, a right rear leg rod, a left rear leg fixing element, a right rear leg fixing element, a left back rest rod, a right back rest rod, a left back rest rod sliding element, a right back rest rod sliding element, a left front leg rod, a right front leg rod, a left front leg terminal, a right front leg terminal, a left connecting rod, a right connecting rod, a left rear leg terminal, a right rear leg terminal, a left handrail rod, a right handrail rod, a left handrail fixing element, a right handrail fixing element, a left handrail supporting rod, a right handrail supporting rod, a left supporting rod sliding element, a right supporting rod sliding element, a left front limiting element, a right front limiting element, a left rear limiting element, a right rear limiting element, a left sliding element, a right sliding element, a first front supporting rod, a second front supporting rod, a first rear supporting rod, a second rear supporting rod, a pad portion and a back rest portion. The left frame rotating element is movably coupled to one end of the left frame rod substantially. The left rear leg sliding element is movably coupled to the other end of the left frame rod. The left rear leg rod is movably, penetratingly disposed at the left rear leg sliding element. The left rear leg fixing element is coupled to one end of the left rear leg rod and movably coupled to left front leg rod. The left back rest rod sliding element movably fits to the left back rest rod. The left front leg rod is movably coupled to the left frame rod. One end of the left front leg rod is movably coupled to the left back rest rod sliding element. The left front leg terminal is movably coupled to the other end of the left front leg rod. One end of the left connecting rod is movably coupled to the left front leg rod. The left rear leg terminal is movably coupled to the other end of the left rear leg rod. One end of the left handrail rod is movably coupled to the left back rest rod. The left frame rotating element is movably disposed at the left handrail supporting rod. The left handrail fixing element is disposed in the vicinity of the other end of the left handrail rod. One end of the left handrail supporting rod is movably coupled to the left handrail fixing element. The left supporting rod sliding element is coupled to the other end of the left handrail supporting rod. The left supporting rod sliding element movably fits to the left front leg rod. The left front limiting element is disposed at the left handrail supporting rod. The left frame rotating element presses against the left front limiting element. The left rear limiting element is disposed at the left rear leg rod. The left sliding element is movably disposed at the left rear leg rod. Two sides of the left sliding element are pivotally connected to one end of the left back rest rod and the other end of the left connecting rod, respectively. The left sliding element presses against the left rear limiting element. The right frame rotating element is movably coupled to one end of the right frame rod substantially. The right rear leg sliding element is movably coupled to the other end of the right frame rod. The right rear leg rod is movably, penetratingly disposed at the right rear leg sliding element. The right rear leg fixing element is coupled to one end of the right rear leg rod and movably coupled to the right front leg rod. The right back rest rod sliding element movably fits to the right back rest rod. The right front leg rod is movably coupled to the right frame rod. One end of the right front leg rod is movably coupled to the right back rest rod sliding element. The right front leg terminal is movably coupled to the other end of the right front leg rod. One end of the right connecting rod is movably coupled to the right front leg rod. The right rear leg terminal is movably coupled to the other end of the right rear leg rod. One end of the right handrail rod is movably coupled to the right back rest rod. The right frame rotating element is movably disposed at the right handrail supporting rod. The right handrail fixing element is disposed in the vicinity of the other end of the right handrail rod. One end of the right handrail supporting rod is movably coupled to the right handrail fixing element. The right supporting rod sliding element is coupled to the other end of the right handrail supporting rod. The right supporting rod sliding element movably fits to the right front leg rod. The right front limiting element is disposed at the right handrail supporting rod. The right frame rotating element presses against the right front limiting element. The right rear limiting element is disposed at the right rear leg rod. The right sliding element is movably disposed at the right rear leg rod. Two sides of the right sliding element are pivotally connected to one end of the right back rest rod and the other end of the right connecting rod, respectively. The right sliding element presses against the right rear limiting element. The first front supporting rod and the second front supporting rod cross each other and are movably coupled together. One end of the first front supporting rod is movably coupled to the left frame rotating element. The other end of the first front supporting rod is movably coupled to the right front leg terminal. One end of the second front supporting rod is movably coupled to the right frame rotating element. The other end of the second front supporting rod is movably coupled to the left front leg terminal. The first rear supporting rod and the second rear supporting rod cross each other and are movably coupled together. One end of the first rear supporting rod is movably coupled to the left back rest rod sliding element. The other end of the first rear supporting rod is movably coupled to the right rear leg terminal. One end of the second rear supporting rod is movably coupled to the right back rest rod sliding element. The other end of the second rear supporting rod is movably coupled to the left rear leg terminal. The pad portion is disposed at the left frame rod and the right frame rod. The back rest portion is disposed at the left back rest rod and the right back rest rod.

In an embodiment of the folding chair, the left frame rotating element has a first pivotal connection portion, a first pivotally connecting and straddlingly connecting portion and a first fitting portion. The first pivotally connecting and straddlingly connecting portion is disposed on the top surface of the first pivotal connection portion. The first fitting portion is disposed on one side of the first pivotal connection portion. One end of the first front supporting rod is movably coupled to the first pivotal connection portion. The left frame rod is movably coupled to the first pivotally connecting and straddlingly connecting portion. The left handrail supporting rod is movably, penetratingly disposed at the first fitting portion.

In an embodiment of the folding chair, the left rear leg sliding element has a second fitting portion and a second pivotal connection portion. The second pivotal connection portion is disposed on one side of the second fitting portion. The left rear leg rod is movably, penetratingly disposed at the second fitting portion. The other end of the left frame rod is movably coupled to the second pivotal connection portion.

In an embodiment of the folding chair, the left rear leg fixing element has a third pivotally connecting and straddlingly connecting portion and a ninth fitting portion. The third pivotally connecting and straddlingly connecting portion is disposed on one side of the ninth fitting portion. The left front leg rod is movably coupled to the third pivotally connecting and straddlingly connecting portion. One end of the left rear leg rod is coupled to the ninth fitting portion.

In an embodiment of the folding chair, the right sliding element has a fourth pivotal connection portion, and another end of the right connecting rod is movably coupled to the fourth pivotal connection portion, the left back rest rod sliding element has a third fitting portion, a fifth pivotal connection portion and a sixth pivotal connection portion. The fifth pivotal connection portion is disposed at one end of the third fitting portion. The sixth pivotal connection portion is disposed on one side of the third fitting portion. The left back rest rod is movably, penetratingly disposed at the third fitting portion. One end of the left front leg rod is movably coupled to the fifth pivotal connection portion. One end of the first rear supporting rod is movably coupled to the sixth pivotal connection portion.

In an embodiment of the folding chair, the left sliding element has a fourth fitting portion, a seventh pivotal connection portion and an eighth pivotal connection portion. The seventh pivotal connection portion and the eighth pivotal connection portion are disposed on two sides of the fourth fitting portion, respectively. The left rear leg rod is movably, penetratingly disposed at the fourth fitting portion. One end of the left back rest rod is movably coupled to the seventh pivotal connection portion. The other end of the left connecting rod is movably coupled to the eighth pivotal connection portion.

In an embodiment of the folding chair, the right frame rotating element has a ninth pivotal connection portion, a second pivotally connecting and straddlingly connecting portion and a fifth fitting portion. The second pivotally connecting and straddlingly connecting portion is disposed on the top surface of the ninth pivotal connection portion. The fifth fitting portion is disposed on one side of the ninth pivotal connection portion. One end of the second front supporting rod is movably coupled to the ninth pivotal connection portion. The right frame rod is movably coupled to the second pivotally connecting and straddlingly connecting portion. The right handrail supporting rod is movably, penetratingly disposed at the fifth fitting portion.

In an embodiment of the folding chair, the right rear leg sliding element has a sixth fitting portion and a tenth pivotal connection portion. The tenth pivotal connection portion is disposed on one side of the sixth fitting portion. The right rear leg rod is movably, penetratingly disposed at the sixth fitting portion. The other end of the right frame rod is movably coupled to the tenth pivotal connection portion.

In an embodiment of the folding chair, the right rear leg fixing element has a fourth pivotally connecting and straddlingly connecting portion and a tenth fitting portion. The fourth pivotally connecting and straddlingly connecting portion is disposed on one side of the tenth fitting portion. The right front leg rod is movably coupled to the fourth pivotally connecting and straddlingly connecting portion. One end of the right rear leg rod is coupled to the tenth fitting portion.

In an embodiment of the folding chair, the right sliding element has an eighth fitting portion, one end of the right back rest rod is movably coupled to the eleventh pivotal connection portion, the right back rest rod sliding element has a seventh fitting portion, a thirteenth pivotal connection portion and a twelfth pivotal connection portion. The thirteenth pivotal connection portion is disposed at one end of the seventh fitting portion. The twelfth pivotal connection portion is disposed on one side of the seventh fitting portion. The right back rest rod is movably, penetratingly disposed at the seventh fitting portion. One end of the right front leg rod is movably coupled to the thirteenth pivotal connection portion. One end of the second rear supporting rod is movably coupled to the twelfth pivotal connection portion.

In an embodiment of the folding chair, the right sliding element has an eighth fitting portion, a eleventh pivotal connection portion and a fourth pivotal connection portion. The eleventh pivotal connection portion and the fourth pivotal connection portion are disposed on two sides of the eighth fitting portion, respectively. The right rear leg rod is movably, penetratingly disposed at the eighth fitting portion. One end of the right back rest rod is movably coupled to the eleventh pivotal connection portion. The other end of the right connecting rod is movably coupled to the fourth pivotal connection portion.

In an embodiment of the folding chair, the folding chair further comprises a left connecting element and a right connecting element. The left connecting element is disposed at the left frame rod. The left connecting element movably fits to the left front limiting element. The right connecting element is disposed at the right frame rod. The right connecting element movably fits to the right front limiting element.

Therefore, the folding chair of the present disclosure can be folded up like an umbrella and thus takes up little space and is portable and can be unfolded to demonstrate high stability and high load-bearing capability.

DETAILED DESCRIPTION OF THE INVENTION

Figure 1:
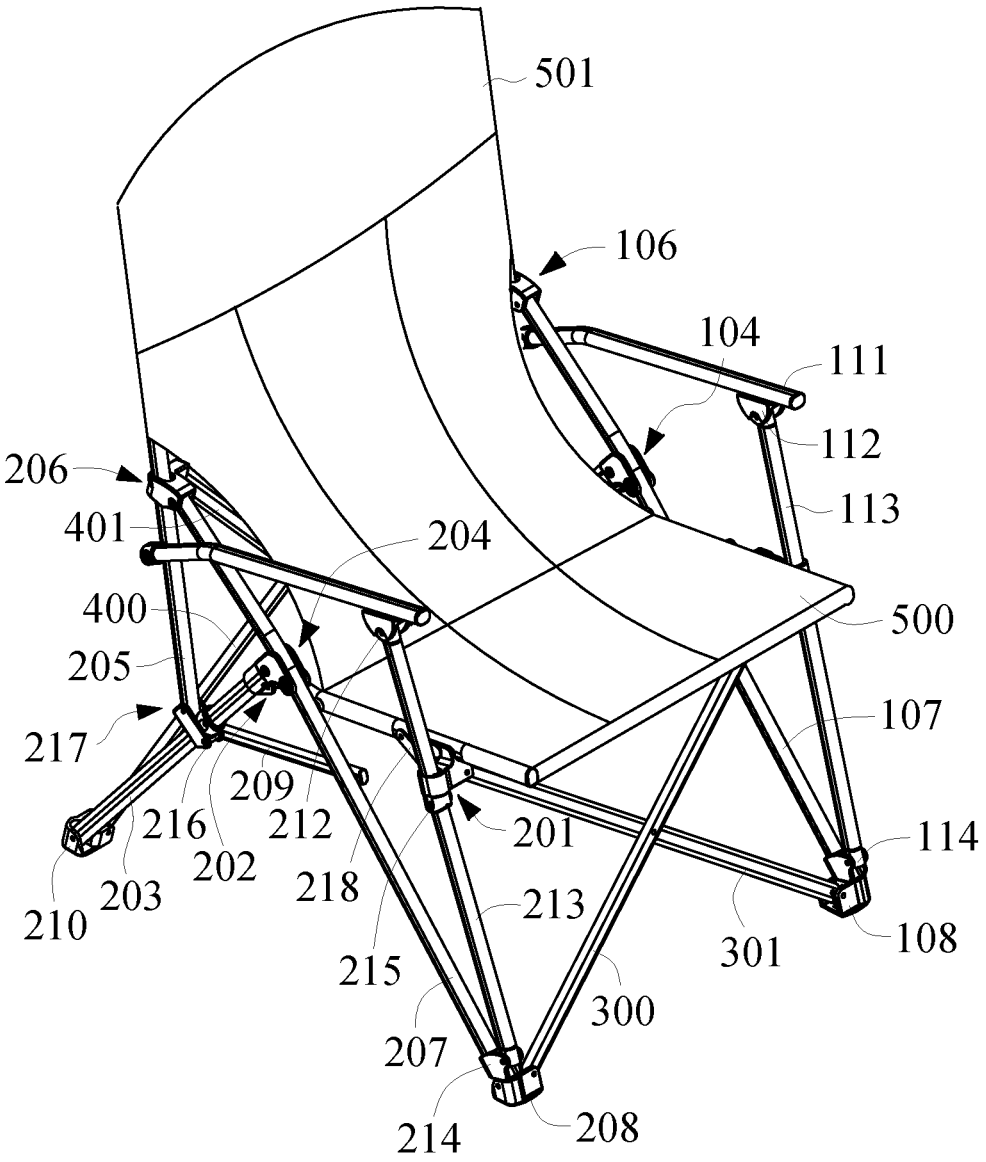
FIG. 1 is a schematic view of a folding chair unfolded according to the present disclosure.

Objectives, features, and advantages of the present disclosure are hereunder illustrated with specific embodiments, depicted with drawings, and described below.

Referring to FIG. 1 through FIG. 4, the present disclosure provides a folding chair comprising a left frame rod 100, a right frame rod 200, a left frame rotating element 101, a right frame rotating element 201, a left rear leg sliding element 102, a right rear leg sliding element 202, a left rear leg rod 103, a right rear leg rod 203, a left rear leg fixing element 104, a right rear leg fixing element 204, a left back rest rod 105, a right back rest rod 205, a left back rest rod sliding element 106, a right back rest rod sliding element 206, a left front leg rod 107, a right front leg rod 207, a left front leg terminal 108, a right front leg terminal 208, a left connecting rod 109, a right connecting rod 209, a left rear leg terminal 110, a right rear leg terminal 210, a left handrail rod 111, a right handrail rod 211, a left handrail fixing element 112, a right handrail fixing element 212, a left handrail supporting rod 113, a right handrail supporting rod 213, a left supporting rod sliding element 114, a right supporting rod sliding element 214, a left front limiting element 115, a right front limiting element 215, a left rear limiting element 116, a right rear limiting element 216, a left sliding element 117, a right sliding element 217, a first front supporting rod 300, a second front supporting rod 301, a first rear supporting rod 400, a second rear supporting rod 401, a pad portion 500 and a back rest portion 501.

The left frame rotating element 101 is movably coupled to one end of the left frame rod 100 substantially. The left rear leg sliding element 102 is movably coupled to the other end of the left frame rod 100. The left rear leg rod 103 is movably, penetratingly disposed at the left rear leg sliding element 102. The left rear leg fixing element 104 is coupled to one end of the left rear leg rod 103 and movably coupled to left front leg rod 107. The left back rest rod sliding element 106 movably fits to the left back rest rod 105. The left front leg rod 107 is movably coupled to the left frame rod 100. One end of the left front leg rod 107 is movably coupled to the left back rest rod sliding element 106. The left front leg terminal 108 is movably coupled to the other end of the left front leg rod 107. One end of the left connecting rod 109 is movably coupled to the left front leg rod 107. The left rear leg terminal 110 is movably coupled to the other end of the left rear leg rod 103. One end of the left handrail rod 111 is movably coupled to the left back rest rod 105. The left frame rotating element 101 is movably disposed at the left handrail supporting rod 113. The left handrail fixing element 112 is disposed in the vicinity of the other end of the left handrail rod 111. One end of the left handrail supporting rod 113 is movably coupled to the left handrail fixing element 112. The left supporting rod sliding element 114 is coupled to the other end of the left handrail supporting rod 113. The left supporting rod sliding element 114 movably fits to the left front leg rod 107. The left front limiting element 115 is disposed at the left handrail supporting rod 113. The left frame rotating element 101 presses against the left front limiting element 115. The left rear limiting element 116 is disposed at the left rear leg rod 103. The left sliding element 117 is movably disposed at the left rear leg rod 103. Two sides of the left sliding element 117 are pivotally connected to one end of the left back rest rod 105 and the other end of the left connecting rod 109, respectively. The left sliding element 117 presses against the left rear limiting element 116.

The right frame rotating element 201 is movably coupled to one end of the right frame rod 200 substantially. The right rear leg sliding element 202 is movably coupled to the other end of the right frame rod 200. The right rear leg rod 203 is movably, penetratingly disposed at the right rear leg sliding element 202. The right rear leg fixing element 204 is coupled to one end of the right rear leg rod 203 and movably coupled to right front leg rod 207. The right back rest rod sliding element 206 movably fits to the right back rest rod 205. One end of the right front leg rod 207 is movably coupled to the right back rest rod sliding element 206. The right front leg rod 207 is movably coupled to the right frame rod 200. The right front leg terminal 208 is movably coupled to the other end of the right front leg rod 207. One end of the right connecting rod 209 is movably coupled to the right front leg rod 207. The right rear leg terminal 210 is movably coupled to the other end of the right rear leg rod 203. One end of the right handrail rod 211 is movably coupled to the right back rest rod 205. The right frame rotating element 201 is movably disposed at the right handrail supporting rod 213. The right handrail fixing element 212 is disposed in the vicinity of the other end of the right handrail rod 211. One end of the right handrail supporting rod 213 is movably coupled to the right handrail fixing element 212. The right supporting rod sliding element 214 is coupled to the other end of the right handrail supporting rod 213. The right supporting rod sliding element 214 movably fits to the right front leg rod 207. The right front limiting element 215 is disposed at the right handrail supporting rod 213. The right frame rotating element 201 presses against the right front limiting element 215. The right rear limiting element 216 is disposed at the right rear leg rod 203. The right sliding element 217 is movably disposed at the right rear leg rod 203, and Two sides of the right sliding element 217 are pivotally connected to one end of the right back rest rod 205 and the other end of the right connecting rod 209, respectively. The right sliding element 217 presses against the right rear limiting element 216.

The first front supporting rod 300 and the second front supporting rod 301 cross each other and are movably coupled together. One end of the first front supporting rod 300 is movably coupled to the left frame rotating element 101. The other end of the first front supporting rod 300 is movably coupled to the right front leg terminal 208. One end of the second front supporting rod 301 is movably coupled to the right frame rotating element 201. The other end of the second front supporting rod 301 is movably coupled to the left front leg terminal 108. The first rear supporting rod 400 and the second rear supporting rod 401 cross each other and are movably coupled together. One end of the first rear supporting rod 400 is movably coupled to the left back rest rod sliding element 106. The other end of the first rear supporting rod 400 is movably coupled to the right rear leg terminal 210. One end of the second rear supporting rod 401 is movably coupled to the right back rest rod sliding element 206. The other end of the second rear supporting rod 401 is movably coupled to the left rear leg terminal 110.

The pad portion 500 is disposed at the left frame rod 100 and the right frame rod 200. The back rest portion 501 is disposed at the left back rest rod 105 and the right back rest rod 205. The back rest portion 501 is connected to the pad portion 500. The pad portion 500 and the back rest portion 501 is made of a soft material, such as fabric or plastic. Therefore, a user can sit on the pad portion 500 with his back pressing against the back rest portion 501 to enhance user experience, as shown in FIG. 1.

Figure 2:
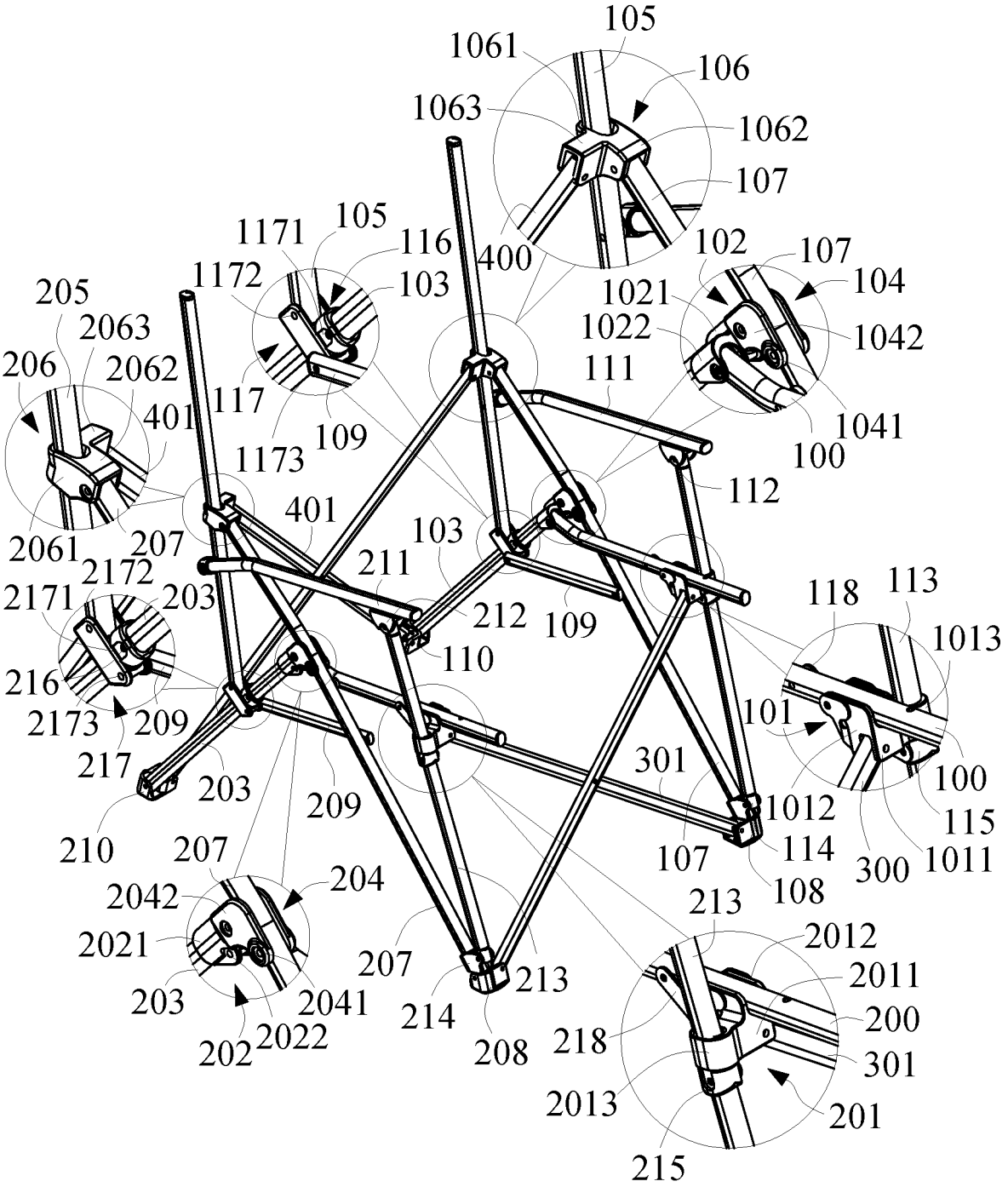
FIG. 2 is a schematic view of the folding chair unfolded according to the present disclosure, omitting a pad portion and a back rest portion.
Figure 3:
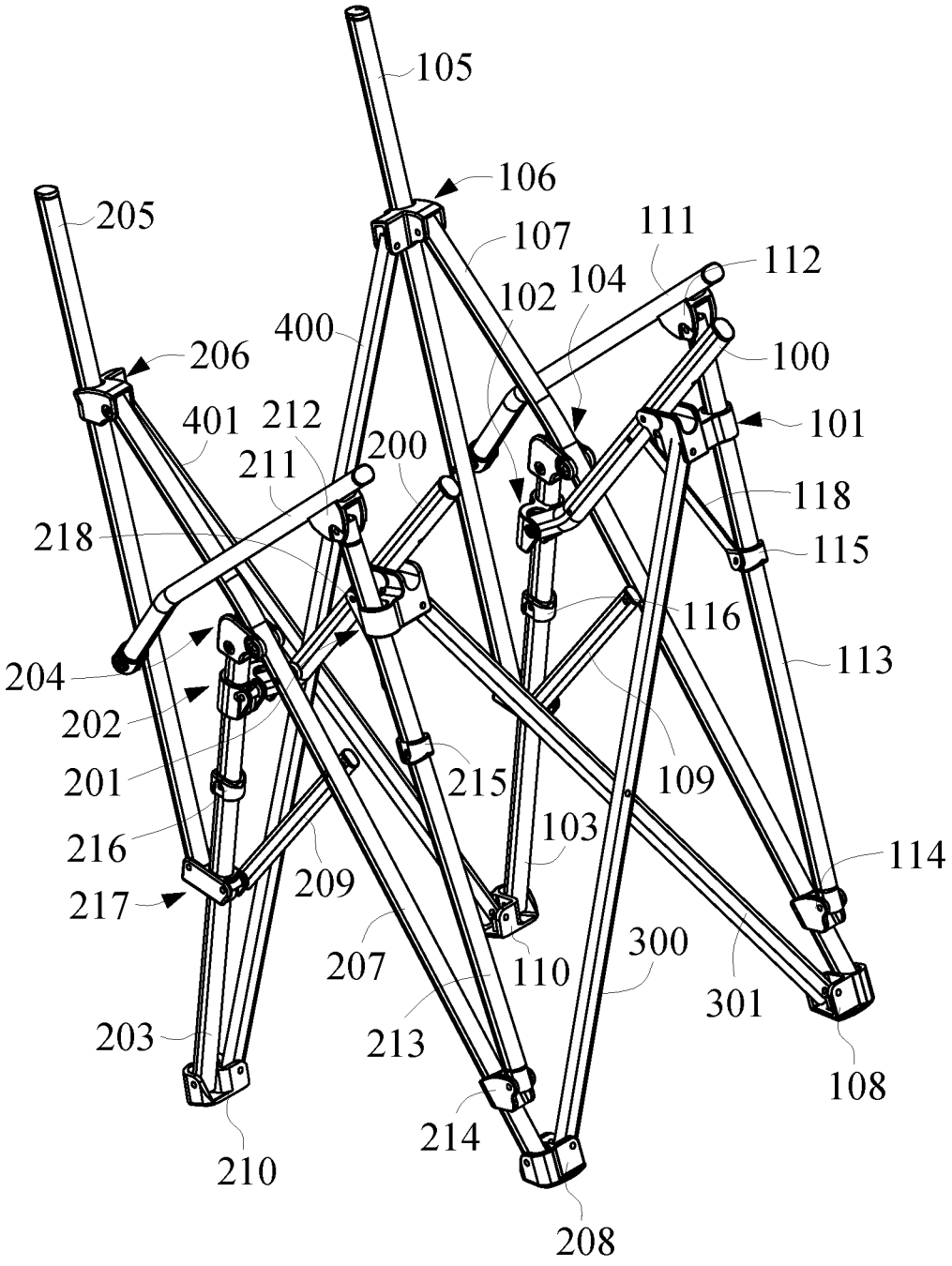
FIG. 3 is a schematic view of the folding chair folded according to the present disclosure, omitting a pad portion and a back rest portion.
Figure 4:
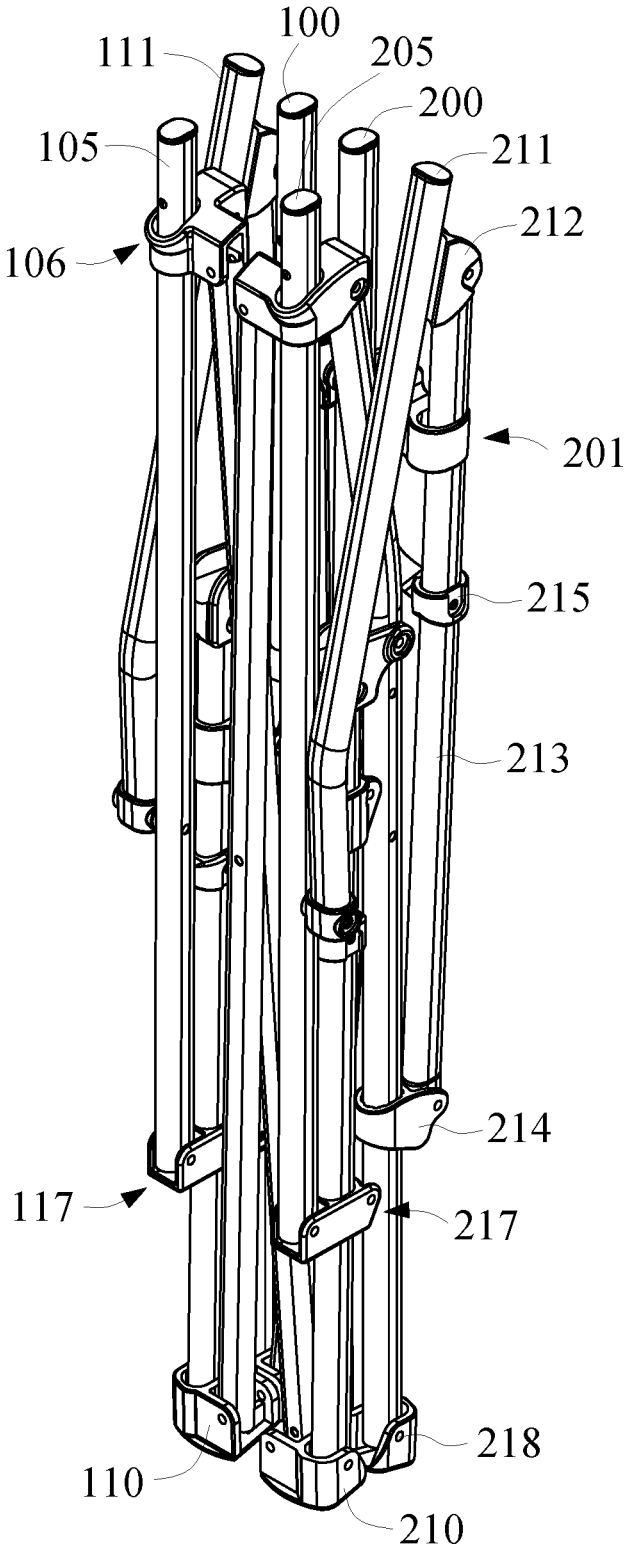
FIG. 4 is another schematic view of the folding chair folded according to the present disclosure, omitting a pad portion and a back rest portion.

Referring to FIG. 2 through FIG. 4, to fold the folding chair, the user grips one end of the left back rest rod 105 (or the right back rest rod 205) and one end of the left frame rod 100 (or the right frame rod 200), moves the left frame rod 100 toward the left back rest rod 105 such that the left frame rod 100 moves out of the left frame rotating element 101 and rotates relative to the left frame rotating element 101, allowing the left frame rod 100 to rotate relative to the left front leg rod 107 and thus allowing the left front leg rod 107 to drive the movement of the left sliding element 117. Afterward, owing to the left sliding element 117, the left back rest rod 105 and the left connecting rod 109 move toward the left rear leg rod 103 such that the left rear leg rod 103 moves toward the left front leg rod 107. Hence, the left frame rotating element 101 moves away from the left front limiting element 115 to thereby cause the separation of the left connecting element 118 and the left front limiting element 115. Hence, the first front supporting rod 300 drives the right front leg terminal 208 to move toward the left front leg terminal 108, causes the left rear leg sliding element 102 to slide the left rear leg fixing element 104 relative to the left rear leg rod 103, and causes the left frame rotating element 101 to drive the left handrail supporting rod 113 to move up because of the left supporting rod sliding element 114. While the left handrail supporting rod 113 is moving up, the left handrail rod 111 moves toward the left back rest rod 105 because of the left handrail fixing element 112. The movement of the left front leg rod 107 causes the left back rest rod sliding element 106 to move up relative to the left back rest rod 105. The upward movement of the left back rest rod sliding element 106 causes the first rear supporting rod 400 and the right rear leg terminal 210 to move toward the left back rest rod 105. While the aforesaid events are in progress, the right frame rod 200 moves toward the right back rest rod 205 such that the right frame rod 200 moves out of the right frame rotating element 201 and rotates relative to the right frame rotating element 201, not only causing the right frame rod 200 to rotate relative to the right front leg rod 207, but also causing the right front leg rod 207 to drive the right sliding element 217. Furthermore, owing to the right sliding element 217, the right back rest rod 205 and the right connecting rod 209 move toward the right rear leg rod 203, causing the right rear leg rod 203 to move toward the right front leg rod 207. In addition, the right frame rotating element 201 moves away from the right front limiting element 215 to thereby cause the separation of the right connecting element 218 and the right front limiting element 215 such that the second front supporting rod 301 drives the left front leg terminal 108 to move toward the right front leg terminal 208, cause the right rear leg sliding element 202 to slide away from the right rear leg fixing element 204 relative to the right rear leg rod 203, and cause the right frame rotating element 201 to drive the right handrail supporting rod 213 to move up because of the right supporting rod sliding element 214. While the right handrail supporting rod 213 is moving up, the right handrail rod 211 moves toward the right back rest rod 205 because of the right handrail fixing element 212. The movement of the right front leg rod 207 causes the right back rest rod sliding element 206 to move up relative to the right back rest rod 205. The upward movement of the right back rest rod sliding element 206 causes the second rear supporting rod 401 and the left rear leg terminal 110 to move toward the right back rest rod 205. Therefore, the folding chair can be folded up like an umbrella and thus takes up little space and is portable.

Regardless of whether the folding chair is folded or unfolded, the left front leg terminal 108, the left rear leg terminal 110, the right front leg terminal 208 and the right rear leg terminal 201 provide protection to the left front leg rod 107, the second front supporting rod 301, the left rear leg rod 103, the second rear supporting rod 401, the right front leg rod 207, the first front supporting rod 300, the right rear leg rod 203 and the first rear supporting rod 400, respectively. Furthermore, they are prevented from coming into direct contact with the ground to otherwise get damaged, and their movement is insusceptible to skidding, thereby allowing the folding chair to demonstrate high stability and high load-bearing capability.

In an embodiment of the present disclosure, as shown in FIG. 2 through FIG. 4, the left frame rotating element 101 has a first pivotal connection portion 1011, a first pivotally connecting and straddlingly connecting portion 1012 and a first fitting portion 1013. The first pivotally connecting and straddlingly connecting portion 1012 is disposed on the top surface of the first pivotal connection portion 1011. The first fitting portion 1013 is disposed on one side of the first pivotal connection portion 1011. One end of the first front supporting rod 300 is movably coupled to the first pivotal connection portion 1011. The left frame rod 100 is movably coupled to the first pivotally connecting and straddlingly connecting portion 1012. The left handrail supporting rod 113 is movably, penetratingly disposed at the first fitting portion 1013. Therefore, to unfold the folding chair, the left frame rod 100 moves into the first pivotally connecting and straddlingly connecting portion 1012 to fit thereto, and the first front supporting rod 300 is driven by the first pivotal connection portion 1011 of the left frame rotating element 101, not only allowing the left frame rotating element 101 to drive the first front supporting rod 300 easily, but also allowing the left frame rod 100 and the first front supporting rod 300 to have high stability and high load-bearing capability after the folding chair has been unfolded.

In an embodiment of the present disclosure, as shown in FIG. 2 through FIG. 4, the left rear leg sliding element 102 has a second fitting portion 1021 and a second pivotal connection portion 1022. The second pivotal connection portion 1022 is disposed on one side of the second fitting portion 1021. The left rear leg rod 103 is movably, penetratingly disposed at the second fitting portion 1021. The other end of the left frame rod 100 is movably coupled to the second pivotal connection portion 1022. Therefore, regardless of whether the folding chair is folded or unfolded, the left rear leg sliding element 102 slides down or slides up relative to the left rear leg rod 103 because of the second fitting portion 1021, whereas the left frame rod 100 moves away from or moves into the first pivotally connecting and straddlingly connecting portion 1012 because of the second pivotal connection portion 1022. Therefore, not only does the left rear leg sliding element 102 move smoothly, but the left frame rod 100 also has high stability and high load-bearing capability after the folding chair has been unfolded.

In an embodiment of the present disclosure, as shown in FIG. 2 through FIG. 4, the left rear leg fixing element 104 has a third pivotally connecting and straddlingly connecting portion 1041 and a ninth fitting portion 1042. The third pivotally connecting and straddlingly connecting portion 1041 is disposed on one side of the ninth fitting portion 1042. The middle of the left front leg rod 107 is movably coupled to the third pivotally connecting and straddlingly connecting portion 1041. One end of the left rear leg rod 103 is coupled to the ninth fitting portion 1042. Therefore, regardless of whether the folding chair is folded or unfolded, the left rear leg rod 103 moves toward the left front leg rod 107 or moves away from the left front leg rod 107 because of the ninth fitting portion 1042, and the left front leg rod 107 moves toward the left rear leg rod 103 or moves away from the left rear leg rod 103 because of the third pivotally connecting and straddlingly connecting portion 1041, not only allowing the left rear leg rod 103 and the left front leg rod 107 to move smoothly, but also allowing the left rear leg rod 103 and the left front leg rod 107 to have high stability and high load-bearing capability after the folding chair has been unfolded.

In an embodiment of the present disclosure, as shown in FIG. 2 through FIG. 4, the left back rest rod sliding element 106 has a third fitting portion 1061, a fifth pivotal connection portion 1062 and a sixth pivotal connection portion 1063. The fifth pivotal connection portion 1062 is disposed at one end of the third fitting portion 1061. The sixth pivotal connection portion 1063 is disposed on one side of the third fitting portion 1061. The left back rest rod 105 is movably, penetratingly disposed at the third fitting portion 1061. The left front leg rod 107 has one end movably coupled to the fifth pivotal connection portion 1062. The first rear supporting rod 400 has one end movably coupled to the sixth pivotal connection portion 1063. Therefore, regardless of whether the folding chair is folded or unfolded, the left back rest rod sliding element 106 slides down or slides up relative to the left back rest rod 105 because of the third fitting portion 1061, allowing the left front leg rod 107 to move toward the left rear leg rod 103 or move away from the left rear leg rod 103 because of the coordination of the fifth pivotal connection portion 1062 and the sixth pivotal connection portion 1063, allowing the first rear supporting rod 400 to move toward the left back rest rod 105 or move away from the left back rest rod 105. Therefore, not only does the left back rest rod sliding element 106 move smoothly, but the left back rest rod 105, the left front leg rod 107 and the first rear supporting rod 400 also have high stability and high load-bearing capability after the folding chair has been unfolded.

In an embodiment of the present disclosure, as shown in FIG. 2 through FIG. 4, the left sliding element 117 has a fourth fitting portion 1171, a seventh pivotal connection portion 1172 and an eighth pivotal connection portion 1173, The seventh pivotal connection portion 1172 and the eighth pivotal connection portion 1173 are disposed on two sides of the fourth fitting portion 1171, respectively. The left rear leg rod 103 is movably, penetratingly disposed at the fourth fitting portion 1171. The left back rest rod 105 has one end movably coupled to the seventh pivotal connection portion 1172. The other end of the left connecting rod 109 is movably coupled to the eighth pivotal connection portion 1173. Therefore, the left sliding element 117 slides relative to the left rear leg rod 103 because of the fourth fitting portion 1171, whereas the left back rest rod 105 and the left connecting rod 109 move toward the left rear leg rod 103 because of the coordination of the seventh pivotal connection portion 1172 and the eighth pivotal connection portion 1173. Therefore, not only do the left back rest rod 105 and the left connecting rod 109 move smoothly, but the left back rest rod 105 and the left connecting rod 109 also have high stability and high load-bearing capability after the folding chair has been unfolded.

In an embodiment of the present disclosure, as shown in FIG. 2 through FIG. 4, the right frame rotating element 201 has a ninth pivotal connection portion 2011, a second pivotally connecting and straddlingly connecting portion 2012 and a fifth fitting portion 2013. The second pivotally connecting and straddlingly connecting portion 2012 is disposed on the top surface of the ninth pivotal connection portion 2011. The fifth fitting portion 2013 is disposed on one side of the ninth pivotal connection portion 2011. One end of the second front supporting rod 301 is movably coupled to the ninth pivotal connection portion 2011. The right frame rod 200 is movably coupled to the second pivotally connecting and straddlingly connecting portion 2012. The right handrail supporting rod 213 is movably, penetratingly disposed at the fifth fitting portion 2013. Therefore, to unfold the folding chair, the right frame rod 200 moves into the second pivotally connecting and straddlingly connecting portion 2012 to fit thereto, whereas the ninth pivotal connection portion 2011 of the right frame rotating element 201 drives the second front supporting rod 301, not only allowing the right frame rotating element 201 to drive the second front supporting rod 301 easily, but also allowing the right frame rod 200 and the second front supporting rod 301 to have high stability and high load-bearing capability after the folding chair has been unfolded.

In an embodiment of the present disclosure, as shown in FIG. 2 through FIG. 4, the right rear leg sliding element 202 has a sixth fitting portion 2021 and a tenth pivotal connection portion 2022. The tenth pivotal connection portion 2022 is disposed on one side of the sixth fitting portion 2021. The right rear leg rod 203 is movably, penetratingly disposed at the sixth fitting portion 2021. The other end of the right frame rod 200 is movably coupled to the tenth pivotal connection portion 2022. Therefore, when the folding chair is folded or unfolded, the right rear leg sliding element 202 slides down or slides up along the right rear leg rod 203 because of the sixth fitting portion 2021, whereas the right frame rod 200 moves away from or moves into the second pivotally connecting and straddlingly connecting portion 2012 because of the tenth pivotal connection portion 2022. Therefore, not only does the right rear leg sliding element 202 move smoothly, but the right frame rod 200 also has high stability and high load-bearing capability after the folding chair has been unfolded.

In an embodiment of the present disclosure, as shown in FIG. 2 through FIG. 4, the right rear leg fixing element 204 has a fourth pivotally connecting, a straddlingly connecting portion 2041 and a tenth fitting portion 2042. The fourth pivotally connecting and straddlingly connecting portion

2041 is disposed on one side of the tenth fitting portion 2042. The middle of the right front leg rod 207 is movably coupled to the fourth pivotally connecting and straddlingly connecting portion 2041. One end of the right rear leg rod 203 is coupled to the tenth fitting portion 2042. Therefore, when the folding chair is folded or unfolded, the right rear leg rod 203 moves toward the right front leg rod 207 or moves away from the right front leg rod 207 because of the tenth fitting portion 2042, whereas the right front leg rod 207 moves toward the right rear leg rod 203 or moves away from the right rear leg rod 203 because of the fourth pivotally connecting and straddlingly connecting portion 2041, thereby not only allowing the right rear leg rod 203 and the right front leg rod 207 to move smoothly, but also allowing the right rear leg rod 203 and the right front leg rod 207 to have high stability and high load-bearing capability after the folding chair has been unfolded.

In an embodiment of the present disclosure, as shown in FIG. 2 through FIG. 4, the right back rest rod sliding element 206 has a seventh fitting portion 2061, a thirteenth pivotal connection portion 2062 and a twelfth pivotal connection portion 2063. The thirteenth pivotal connection portion 2062 is disposed at one end of the seventh fitting portion 2061. The twelfth pivotal connection portion 2063 is disposed on one side of the seventh fitting portion 2061. The right back rest rod 205 is movably, penetratingly disposed at the seventh fitting portion 2061. The right front leg rod 207 has one end movably coupled to the thirteenth pivotal connection portion 2062. The second rear supporting rod 401 has one end movably coupled to the twelfth pivotal connection portion 2063. Therefore, when the folding chair is folded or unfolded, the right back rest rod sliding element 206 slides up or slides down relative to the right back rest rod 205 because of the seventh fitting portion 2061 to thereby allow the right front leg rod 207 to move toward the right rear leg rod 203 or move away from the right rear leg rod 203 because of the coordination of the thirteenth pivotal connection portion 2062 and the twelfth pivotal connection portion 2063, and allow the second rear supporting rod 401 to move toward the right back rest rod 205 or move away from the right back rest rod 205 because of the coordination of the thirteenth pivotal connection portion 2062 and the twelfth pivotal connection portion 2063. Therefore, not only does the right back rest rod sliding element 206 move smoothly, but the right back rest rod 205, the right front leg rod 207 and the second rear supporting rod 401 also have high stability and high load-bearing capability after the folding chair has been unfolded.

In an embodiment of the present disclosure, as shown in FIG. 2 through FIG. 4, the right sliding element 217 has an eighth fitting portion 2171, eleventh pivotal connection portion 2172 and a fourth pivotal connection portion 2173. The eleventh pivotal connection portion 2172 and the fourth pivotal connection portion 2173 are disposed on two sides of the eighth fitting portion 2171, respectively, the right rear leg rod 103 is movably, penetratingly disposed at the eighth fitting portion 2171. The right back rest rod 205 has one end movably coupled to the eleventh pivotal connection portion 2172. The other end of the right connecting rod 209 is movably coupled to the fourth pivotal connection portion 2173. Therefore, the right sliding element 217 slides relative to the right rear leg rod 203 because of the eighth fitting portion 2171, whereas the right back rest rod 205 and the right connecting rod 209 move toward the right rear leg rod 203 because of the coordination of the eleventh pivotal connection portion 2172 and the fourth pivotal connection portion 2173. Therefore, not only do the right back rest rod 205 and the right connecting rod 209 move smoothly, but the right back rest rod 205 and the right connecting rod 209 also have high stability and high load-bearing capability after the folding chair has been unfolded.

In an embodiment of the present disclosure, as shown in FIG. 2 through FIG. 4, the folding chair further comprises a left connecting element 118 and a right connecting element 218. The left connecting element 118 is disposed at the left frame rod 100. The left connecting element 118 and the left front limiting element 115 are connected when the folding chair is unfolded but separated when the folding chair is folded. The right connecting element 218 is disposed at the right frame rod 200. The right connecting element 218 and the right front limiting element 215 are connected when the folding chair is unfolded but separated when the folding chair is folded. Therefore, the left connecting element 118 and the right connecting element 218 have high stability and high load-bearing capability when the folding chair is unfolded.

While the present disclosure has been described by means of specific embodiments, numerous modifications and variations could be made thereto by those skilled in the art without departing from the scope and spirit of the present disclosure set forth in the claims.

What is claimed is:

1. A folding chair, comprising:

a left frame rod, a right frame rod, a left frame rotating element, a right frame rotating element, a left rear leg sliding element, a right rear leg sliding element, a left rear leg rod, a right rear leg rod, a left rear leg fixing element, a right rear leg fixing element, a left back rest rod, a right back rest rod, a left back rest rod sliding element, a right back rest rod sliding element, a left front leg rod, a right front leg rod, a left front leg terminal, a right front leg terminal, a left connecting rod, a right connecting rod, a left rear leg terminal, a right rear leg terminal, a left handrail rod, a right handrail rod, a left handrail fixing element, a right handrail fixing element, a left handrail supporting rod, a right handrail supporting rod, a left supporting rod sliding element, a right supporting rod sliding element, a left front limiting element, a right front limiting element, a left rear limiting element, a right rear limiting element, a left sliding element, a right sliding element, a first front supporting rod, a second front supporting rod, a first rear supporting rod, a second rear supporting rod, a pad portion and a back rest portion;

wherein the left frame rotating element is movably coupled to one end of the left frame rod substantially, the left rear leg sliding element is movably coupled to another end of the left frame rod, the left rear leg rod is movably, penetratingly disposed at the left rear leg sliding element, the left rear leg fixing element is coupled to one end of the left rear leg rod and movably coupled to the left front leg rod, the left back rest rod sliding element movably fits to the left back rest rod, the left front leg rod is movably coupled to the left frame rod, one end of the left front leg rod is movably coupled to the left back rest rod sliding element, the left front leg terminal is movably coupled to another end of the left front leg rod, one end of the left connecting rod is movably coupled to the left front leg rod, the left rear leg terminal is movably coupled to another end of the left rear leg rod, one end of the left handrail rod is movably coupled to the left back rest rod, the left frame rotating element is movably disposed at the left handrail supporting rod, the left handrail fixing element is disposed in vicinity of another end of the left handrail rod, one end of the left handrail supporting rod is movably coupled to the left handrail fixing element, the left supporting rod sliding element is coupled to another end of the left handrail supporting rod, the left supporting rod sliding element movably fits to the left front leg rod, the left front limiting element is disposed at the left handrail supporting rod, the left frame rotating element presses against the left front limiting element, the left rear limiting element is disposed at the left rear leg rod, the left sliding element is movably disposed at the left rear leg rod, two sides of the left sliding element are pivotally connected to one end of the left back rest rod and another end of the left connecting rod, respectively, and the left sliding element presses against the left rear limiting element;

wherein the right frame rotating element is movably coupled to one end of the right frame rod substantially, the right rear leg sliding element is movably coupled to another end of the right frame rod, the right rear leg rod is movably, penetratingly disposed at the right rear leg sliding element, the right rear leg fixing element is coupled to one end of the right rear leg rod and movably coupled to right front leg rod, the right back rest rod sliding element movably fits to the right back rest rod, the right front leg rod is movably coupled to the right frame rod, one end of the right front leg rod is movably coupled to the right back rest rod sliding element, the right front leg terminal is movably coupled to another end of the right front leg rod, one end of the right connecting rod is movably coupled to the right front leg rod, the right rear leg terminal is movably coupled to another end of the right rear leg rod, one end of the right handrail rod is movably coupled to the right back rest rod, the right frame rotating element is movably disposed at the right handrail supporting rod, the right handrail fixing element is disposed in vicinity of another end of the right handrail rod, one end of the right handrail supporting rod is movably coupled to the right handrail fixing element, the right supporting rod sliding element is coupled to another end of the right handrail supporting rod, the right supporting rod sliding element movably fits to the right front leg rod, the right front limiting element is disposed at the right handrail supporting rod, the right frame rotating element presses against the right front limiting element, the right rear limiting element is disposed at the right rear leg rod, the right sliding element is movably disposed at the right rear leg rod, two sides of the right sliding element are pivotally connected to one end of the right back rest rod and another end of the right connecting rod, respectively, and the right sliding element presses against the right rear limiting element;

wherein the first front supporting rod and the second front supporting rod cross each other and are movably coupled together, one end of the first front supporting rod is movably coupled to the left frame rotating element, another end of the first front supporting rod is movably coupled to the right front leg terminal, one end of the second front supporting rod is movably coupled to the right frame rotating element, another end of the second front supporting rod is movably coupled to the left front leg terminal, the first rear supporting rod and the second rear supporting rod cross each other and are movably coupled together, one end of the first rear supporting rod is movably coupled to the left back rest rod sliding element, another end of the first rear supporting rod is movably coupled to the right rear leg terminal, one end of the second rear supporting rod is movably coupled to the right back rest rod sliding element, and another end of the second rear supporting rod is movably coupled to the left rear leg terminal;

wherein the pad portion is disposed at the left frame rod and the right frame rod, whereas the back rest portion is disposed at the left back rest rod and the right back rest rod.

2. The folding chair of claim 1, wherein the left frame rotating element has a first pivotal connection portion, a first pivotally connecting and straddlingly connecting portion and a first fitting portion, the first pivotally connecting and straddlingly connecting portion is disposed on a top surface of the first pivotal connection portion, the first fitting portion is disposed on one side of the first pivotal connection portion, one end of the first front supporting rod is movably coupled to the first pivotal connection portion, the left frame rod is movably coupled to the first pivotally connecting and straddlingly connecting portion, and the left handrail supporting rod is movably, penetratingly disposed at the first fitting portion.

3. The folding chair of claim 1, wherein the left rear leg sliding element has a second fitting portion and a second pivotal connection portion, the second pivotal connection portion is disposed on one side of the second fitting portion, the left rear leg rod is movably, penetratingly disposed at the second fitting portion, and another end of the left frame rod is movably coupled to the second pivotal connection portion.

4. The folding chair of claim 1, wherein the left rear leg fixing element has a third pivotally connecting and straddlingly connecting portion and a ninth fitting portion, the third pivotally connecting and straddlingly connecting portion is disposed on one side of the ninth fitting portion, the left front leg rod is movably coupled to the third pivotally connecting and straddlingly connecting portion, and one end of the left rear leg rod is coupled to the ninth fitting portion.

5. The folding chair of claim 1, wherein the right sliding element has a fourth pivotal connection portion, and another end of the right connecting rod is movably coupled to the fourth pivotal connection portion, the left back rest rod sliding element has a third fitting portion, a fifth pivotal connection portion and a sixth pivotal connection portion, the fifth pivotal connection portion is disposed at one end of the third fitting portion, the sixth pivotal connection portion is disposed on one side of the third fitting portion, the left back rest rod is movably, penetratingly disposed at the third fitting portion, one end of the left front leg rod is movably coupled to the fifth pivotal connection portion, and one end of the first rear supporting rod is movably coupled to the sixth pivotal connection portion.

6. The folding chair of claim 1, wherein the left sliding element has a fourth fitting portion, a seventh pivotal connection portion and an eighth pivotal connection portion, the seventh pivotal connection portion and the eighth pivotal connection portion are disposed on two sides of the fourth fitting portion, respectively, the left rear leg rod is movably, penetratingly disposed at the fourth fitting portion, one end of the left back rest rod is movably coupled to the seventh pivotal connection portion, and another end of the left connecting rod is movably coupled to the eighth pivotal connection portion.

7. The folding chair of claim 1, wherein the right frame rotating element has a ninth pivotal connection portion, a second pivotally connecting and straddlingly connecting portion and a fifth fitting portion, the second pivotally connecting and straddlingly connecting portion is disposed on a top surface of the ninth pivotal connection portion, the fifth fitting portion is disposed on one side of the ninth pivotal connection portion, one end of the second front supporting rod is movably coupled to the ninth pivotal connection portion, the right frame rod is movably coupled to the second pivotally connecting and straddlingly connecting portion, and the right handrail supporting rod is movably, penetratingly disposed at the fifth fitting portion.

8. The folding chair of claim 1, wherein the right rear leg sliding element has a sixth fitting portion and a tenth pivotal connection portion, the tenth pivotal connection portion is disposed on one side of the sixth fitting portion, the right rear leg rod is movably, penetratingly disposed at the sixth fitting portion, and another end of the right frame rod is movably coupled to the tenth pivotal connection portion.

9. The folding chair of claim 1, wherein the right rear leg fixing element has a fourth pivotally connecting and straddlingly connecting portion and a tenth fitting portion, the fourth pivotally connecting and straddlingly connecting portion is disposed on one side of the tenth fitting portion, the right front leg rod is movably coupled to the fourth pivotally connecting and straddlingly connecting portion, and one end of the right rear leg rod is coupled to the tenth fitting portion.

10. The folding chair of claim 1, wherein the right sliding element has an eighth fitting portion, one end of the right back rest rod is movably coupled to the eleventh pivotal connection portion, the right back rest rod sliding element has a seventh fitting portion, a thirteenth pivotal connection portion and a twelfth pivotal connection portion, the thirteenth pivotal connection portion is disposed at one end of the seventh fitting portion, the twelfth pivotal connection portion is disposed on one side of the seventh fitting portion, the right back rest rod is movably, penetratingly disposed at the seventh fitting portion, one end of the right front leg rod is movably coupled to the thirteenth pivotal connection portion, and one end of the second rear supporting rod is movably coupled to the twelfth pivotal connection portion.

11. The folding chair of claim 1, wherein the right sliding element has an eighth fitting portion, an eleventh pivotal connection portion and a fourth pivotal connection portion, the eleventh pivotal connection portion and the fourth pivotal connection portion are disposed on two sides of the eighth fitting portion, respectively, the right rear leg rod is movably, penetratingly disposed at the eighth fitting portion, one end of the right back rest rod is movably coupled to the eleventh pivotal connection portion, and another end of the right connecting rod is movably coupled to the fourth pivotal connection portion.

12. The folding chair of claim 1, further comprising a left connecting element and a right connecting element, the left connecting element is disposed at the left frame rod, the left connecting element movably fits to the left front limiting element, the right connecting element is disposed at the right frame rod, and the right connecting element movably fits to the right front limiting element.

* * * * *